United States Patent [19]

Schweisfurth

[11] Patent Number: 4,993,408

[45] Date of Patent: Feb. 19, 1991

[54] MASSAGE DEVICE

[76] Inventor: Günter Schweisfurth, Am Glaskopf 68, 5244 Daaden-Biersdorf, Fed. Rep. of Germany

[21] Appl. No.: 483,999

[22] Filed: Feb. 22, 1990

Related U.S. Application Data

[63] Continuation of Ser. No. 330,972, Mar. 28, 1989, abandoned, which is a continuation-in-part of Ser. No. 157,118, Feb. 10, 1988, abandoned, which is a continuation-in-part of Ser. No. 669,593, Nov. 8, 1984, abandoned.

[30] Foreign Application Priority Data

| | | | |
|---|---|---|---|
| Nov. 11, 1983 | [DE] | Fed. Rep. of Germany | 8332382[U] |
| Apr. 12, 1984 | [DE] | Fed. Rep. of Germany | 8411456[U] |
| Sep. 4, 1984 | [DE] | Fed. Rep. of Germany | 8426025[U] |

[51] Int. Cl.[5] ..... A61H 15/00; A61H 7/00

[52] U.S. Cl. ..... 128/57; 128/44

[58] Field of Search ..... 128/44, 56, 57, 59

[56] References Cited

U.S. PATENT DOCUMENTS

| | | | |
|---|---|---|---|
| 444,597 | 1/1891 | Lichtenstadt | 128/57 X |
| 1,111,427 | 9/1914 | Archibald | 128/57 |
| 1,513,475 | 10/1924 | Bell | 128/58 |
| 1,630,149 | 5/1927 | Wahrf | 128/57 |
| 1,710,051 | 4/1929 | Giacopazzi | 128/24.3 |
| 1,910,490 | 5/1933 | Lucas | 128/57 |
| 2,053,145 | 9/1936 | Hamel | 401/269 X |
| 2,306,424 | 12/1942 | Betz | 128/56 |
| 2,317,111 | 4/1943 | Perwas | 401/269 X |
| 2,578,916 | 12/1951 | Belleville | 128/57 |
| 3,273,192 | 9/1966 | Mazzella | 15/144 R |

FOREIGN PATENT DOCUMENTS

| | | | |
|---|---|---|---|
| 841207 | 6/1952 | Fed. Rep. of Germany | 128/57 |
| 805297 | 11/1936 | France | 128/57 |
| 285781 | 2/1928 | United Kingdom | 128/57 |
| 325118 | 2/1930 | United Kingdom | 128/57 |

*Primary Examiner*—Edgar S. Burr
*Assistant Examiner*—Lisa E. Malvaso
*Attorney, Agent, or Firm*—Toren, McGeady & Associates

[57] ABSTRACT

A massage device for rolling massage of skin- and reflex zones of the human body has at least one axis (3) attached at a handle (2) with massage rings (4) arranged freely rotatably thereon, which each carry uniformly distributed needle tips in circumferential direction. Such a massage device enables the surface-rolling massage to be carried out in self-treatment on painful body spots or on reflex zones to be treated, even if they are accessible only with difficulty.

24 Claims, 3 Drawing Sheets

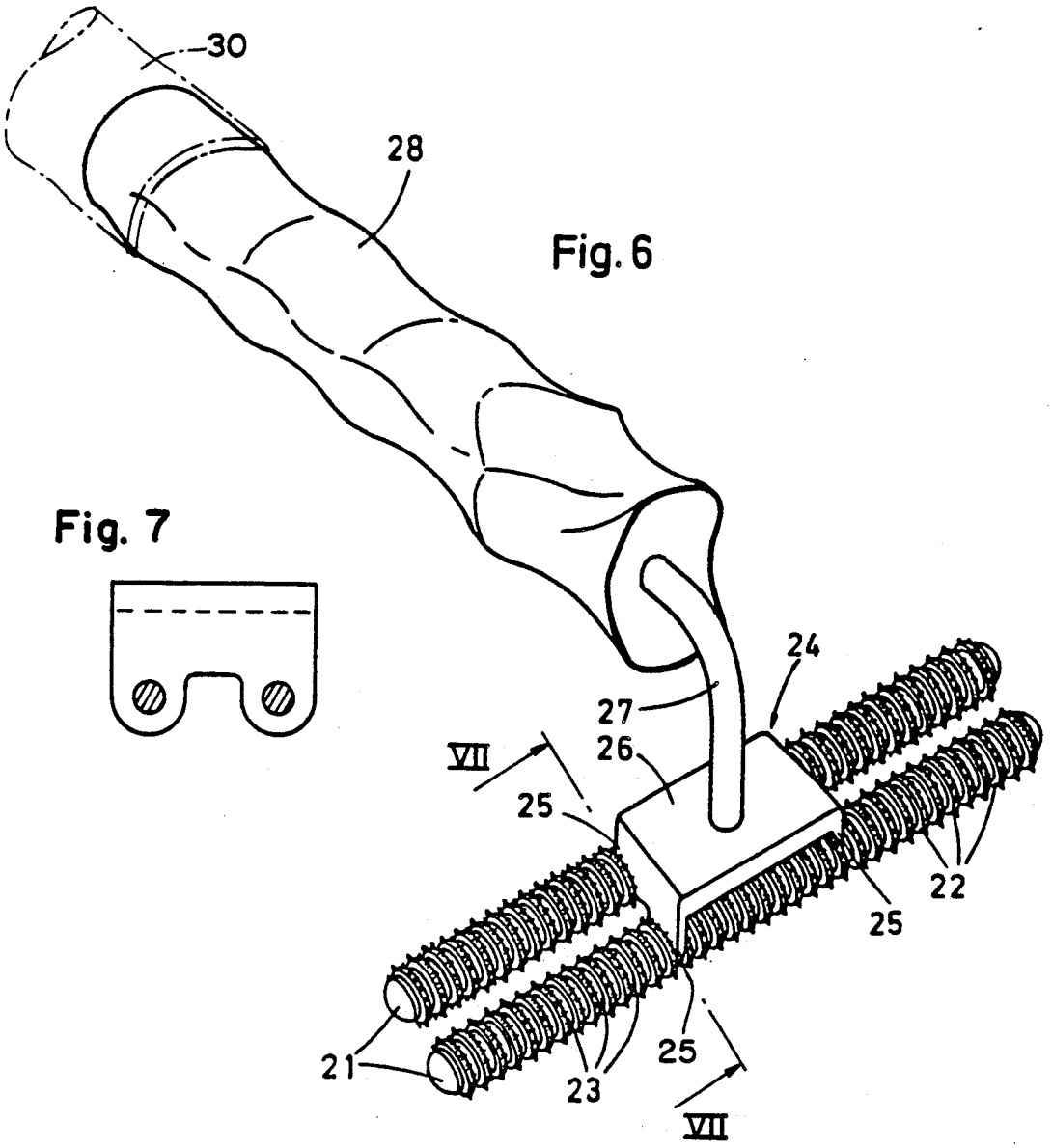
Fig. 6
Fig. 7
Fig. 8
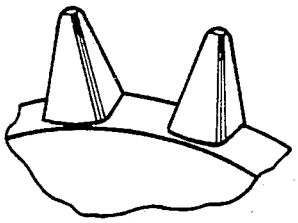

MASSAGE DEVICE

This is a continuation of application Ser. No. 07/330,972, now abandoned, filed Mar. 28, 1989, which in turn is a continuation-in-part of Ser. No. 07/157,118, filed Feb. 10, 1988, now abandoned, which in turn is a continuation-in-part of Ser. No. 06/669,593, filed Nov. 8, 1984, now abandoned.

The invention is directed to a massage device for rolling massage of skin- and reflex zones of the human body.

Such a massage device shall be utilized in self-use for the rolling massage of skin- and reflex zones, because it has been shown, that frequently favorable therapeutic action can be achieved by the skin excitation resulting from the rolling massage, to the extent that good surface massage can be performed on the painful parts of the body and/or the reflex zones concerned.

In the invention this task is solved in a surprisingly easy manner and way, through at least one axis arranged on a handle with freely rotatable massage rings supported thereon, which each carry sharp needle points in uniformly distributed circumferential direction. The needle points are of a non-deformable material, preferably metal, and a height of approximately 1–2 mm. The sharp needle points slightly pierce the skin over which the message device is moved, resulting in an effect similar to acupuncture.

When an optimal surface rolling massage is required in self-treatment at the painful body areas or the reflex zones to be treated, which are relatively unaccessible, for instance are located in the area of the back, then it has proved to be particularly advantageous in accordance with the invention, to design the handle so that it can be at least in part angularly adjustable relative to the axis supporting the massage rings by means of a tranverse articulation from its position aligned with the axis. The hand holding and/or guiding the massage device can then execute the required motions, without getting into extreme positions, which could complicate the desirable intensive handling and thus impair the therapeutic effect.

It has been shown to be particularly successful in this sense, if the angular adjustment sector of the transverse articulation in the device of the invention is at least 35°, so that—depending on the manipulation of the device angular positions between 145° and 215°, are possible between the axis supporting the massage rings and the handle.

In order to ensure good manipulation qualities of the massage device, it is important that at least the two extreme angular positions of the transverse articulation can be positively fixed, for instance be clampable or detentable.

In another invention feature of the massage device, it is preferred that the length of the axis carrying the massage rings is dimensioned to be at least approximately equal to the length of the handle.

The effect of the massage device in accordance with the invention can be further improved, if two parallel axes for the rotatably supported massage rings are provided, whereby both axes are arranged in each case at the end of a crossbar fixed to the handle and at right angles to this crossbar. In moving a massage device so designed across the parts of the body to be treated, both axes are brought into action directly one after the other and the therapeutic effect is thus greatly increased.

It has proved to be advantageous if, in a massage device described above, the thickness of the crossbar is made smaller than the diameter of the massage rings. Thus their effectiveness is not impaired in the area near to the crossbar.

In order to ensure good handling qualities of the massage device just described, the handle is at least to some extent angularly adjustable out of the aligned position with respect to the two axes supporting the massage rings by means of a transverse articulation, whose axis is approximately parallel to the longitudinal direction of the crossbar.

In all the previously described embodiments of massage devices a handle satisfying all the handling requirements should have a length of about 100 mm. In an efficient layout of the massage device it is then to be recommended to utilize the axis carrying the massage rings for the simultaneous rolling massage of surface areas having also widths of about 100 mm.

In order not to damage the needle points on the massage rings of the massage device and in order to avoid that the needle tips themselves damage other objects, it has been provided in the invention that a protective hood can be slid over that portion of the length of the massage device which carries the massage rings. Here the length of the protective hood is made sufficient so as to cover the transverse articulation of the aligned position of the rod-shaped handle with the axis carrying the massage rings, and preferably fashioned so as to also partially overlap the portion of the rod-shaped handle adjacent to the transverse articulation. The protective hood ensures that the massage device can be retained in its aligned spacesaving position and can also be stored in this way.

A massage device according to the invention, with the help of which other persons can be treated, must be laid out so as to permit the masseur as a rule to work on stretched-out persons and enable him to exert pressure on the portions of the body to be treated during the massage operation.

Such a massage device according to the invention is primarily characterized by a U-shaped support piece with eyelets for receiving the axis, disposed in two flanges and aligned with each other, where the handle is connected with the support piece by means of a connecting bolt arranged perpendicularly to the support piece bar.

In such a massage device it is of particular importance that at least two parallel axes carrying massage rings and, in the support piece flanges, a corresponding number of pairs of support eyelets aligned with each other are provided and that further the connecting bolt is arranged at an angle with respect to the handle axis, so that bolt and handle form an obtuse angle of preferably 120°. It is appropriate, if the support piece flanges have a thickness corresponding to the width of the distance rings and each flange is located in between two massage rings next to each other, whereby the needle tips of the massage rings in their peripheral area extend beyond the outside dimensions of the support lugs. Hereby a particularly simple design layout of the massage device is achieved.

In order that the axes carrying the massage rings can assume a slightly crosswise position with respect to each other, it has also been provided in the invention that the axes are supported with a slight play in the support eyelets.

Should the just-explained massage device be also used for self-treatment, which is in principle possible, it is to to be recommended to design the handle to be extendable by a part which can be slid on, where the part to be slid on is firmly detentable with the handle. This extension permits to also reach body parts accessible only with difficulty, for instance the back.

BRIEF DESCRIPTION OF THE DRAWING

In the drawing:

FIG. 6 shows another embodiment of a massage device in perspective presentation; and FIG. 7 is a cross-sectional view taken along sectional lines VIII—VIII in FIG. 6.

Figure 1:
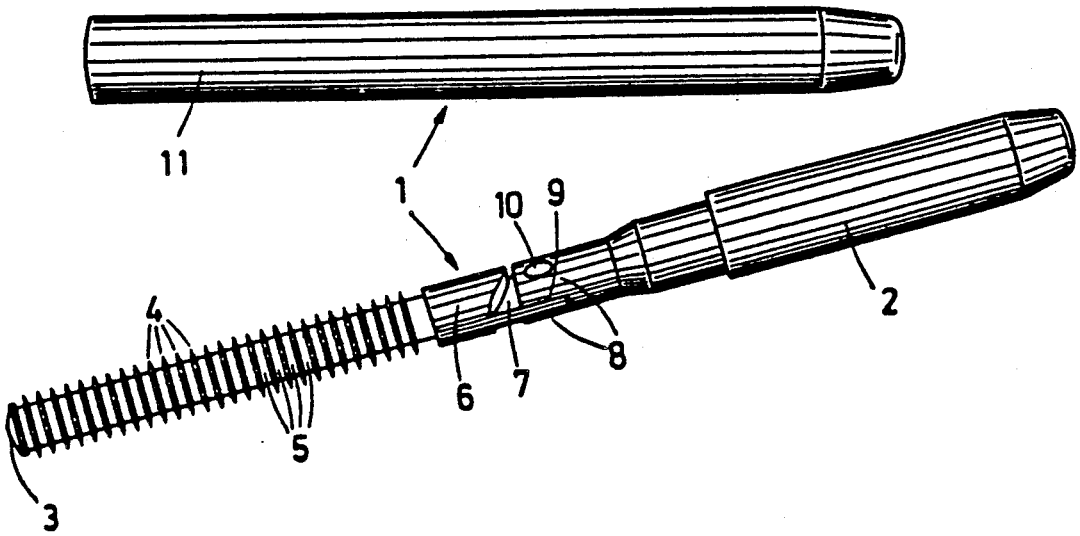
FIG. 1 shows a first embodiment of a massage device with protective hood removed and with the rod-shaped handle and the axis carrying the massage rings in an aligned position.
Figure 2:
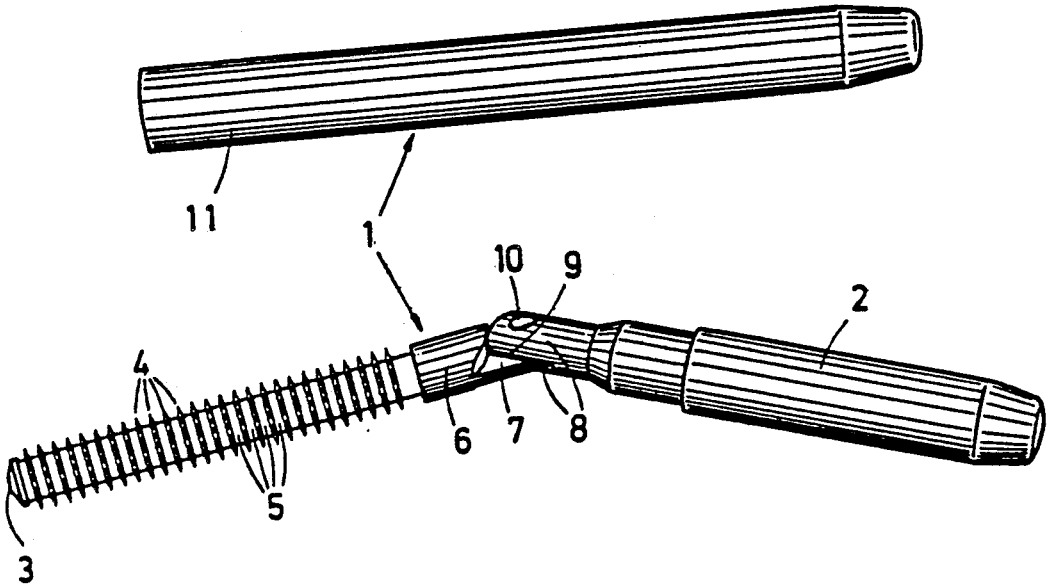
FIG. 2 shows the massage device according to FIG. 1 with the axis carrying the massage rings at an angle relative to the rod-shaped handle.

The massage device 1, depicted in FIGS. 1 and 2, comprises a rod-shaped handle 2, which carries an axis 3, on which are located a multitude of freely rotatably supported silver-coated massage rings 4, which are kept with play at a certain distance from each other by means of interposed distance rings 5. The massage rings 4 have a considerably larger diameter than the distance rings 5 and are equipped with short pyramid-shaped needle tips arranged uniformly distributed along their circumference. It is advantageous to equip each of the massage rings 4 along its circumference with 20 uniformly distributed cone-shaped needle tips and to dimension the distance rings 5 in such a way that a distance of 3 mm exists between the needle points of two massage rings 4 arranged next to each other on the axis 3.

It is appropriate to dimension the length of the axis 3 in such a way that the, for instance 25 to 30, massage rings 4 can be arranged on it with interposition of the distance rings 5. The actual operative portion of the massage device 1 is thus provided with a length dimension which permits simultaneous treatment of larger skin surfaces or reflex zone areas.

The axis 3 supporting the massage rings 4 extends into a shaft 6, which carries at its free end a flat bar projection. This bar projection 7 engages in a slit 9 of a forked shaft 8, which is located at one end of the rod-shaped handle 2. A bolt 10 is inserted through holes in the two legs of the forked shaft 8 and a hole in the bar attachment 7 registering with said two holes and is fastened, for instance by screwing or riveting in such a way that bar attachment 7, fork shaft 8 and bolt 10 form a transverse articulation with each other, by means of which the handle 2 can be angularly adjustable with respect to the axis 3, carrying the massage rings 4, out of the aligned position in FIG. 1, at least partially, for instance up to the angled position shown in FIG. 2. The angular adjustment sector of the transverse articulation is preferably at least 35°. Depending on how the rod-shaped handle 2 is manipulated, the rod-shaped handle 2 and the axis 3 carrying the massage rings 4 assume, during operation of the massage device 1, angular positions of about 145° or 215° with respect to each other.

This angular adjustment of the massage device 1 makes it possible to also reach the relatively inaccessible parts of the body during self-treatment.

It serves an easy treatment reaching large surfaces of the skin and/or reflex zones, to make the length of the axis 3 carrying the massage rings 4 at least approximately equal to the length of the handle 2. If thus the rod-shaped handle 2 has a length of approximately 100 mm, the axis 3 carrying the massage rings 4 could have a minimum length of approximately 90 mm.

It is also important to design the massage device 1 so that its rod-shaped handle 2 and the axis 3 carrying the massage rings 4 are only tightly angle-adjustable with respect to each other by means of the transverse articulation, and that at least the two angular end positions of the transverse articulation, as depicted in FIG. 1 and 2, can be fixed, for instance clamped tightly or detented with respect to each other.

In order to maintain the massage device 1 in an efficient state of operation for along time, it is to be recommended to protect the needle tips of the massage rings 4 against damage. A protective hood, which can be axially slid over the axis 3 carrying the massage rings 4, serves this purpose.

The length of this protective hood 11 is such that it enables covering the transverse articulation 7, 8, 9, 10, if the rod-shaped handle 2 is aligned with the axis 3 carrying the massage rings 4 as is depicted in FIG. 1. The protective hood 11 then holds the massage device 1 in its straight position, for instance to be able to store it in a confined space.

Figure 3:
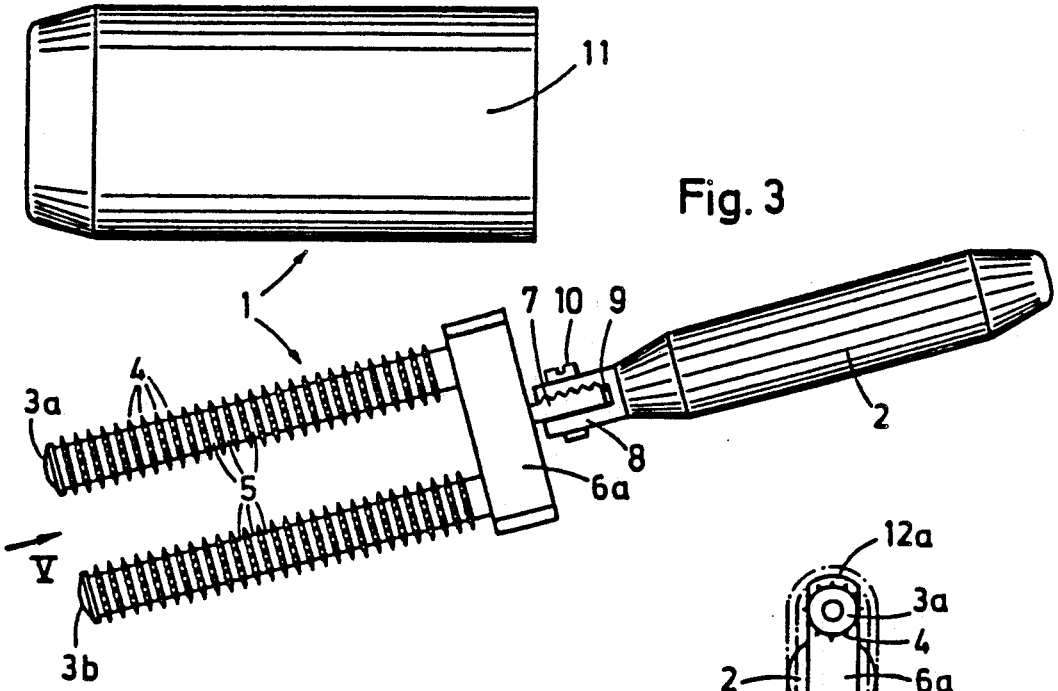
FIG. 3 is a side view of another embodiment of a massage device with the protective hood removed.
Figure 4:
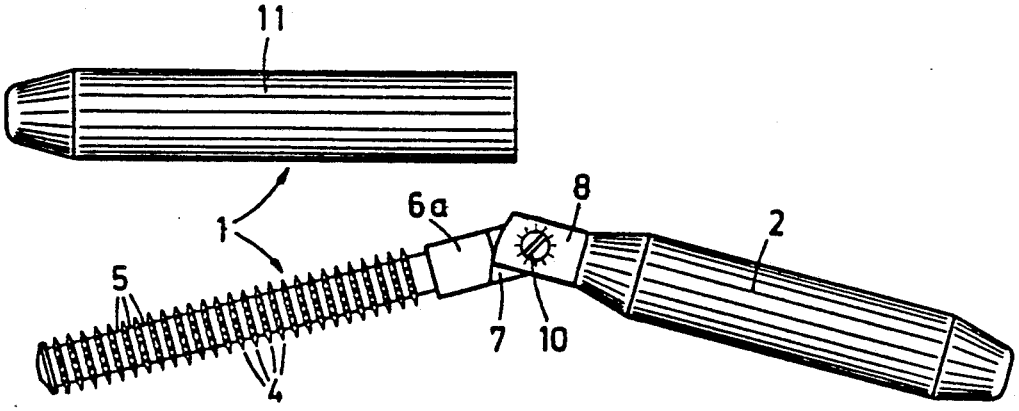
FIG. 4 shows the massage device according to FIG. 3 in a position turned by 90° with respect to that shown in FIG. 3, whereby the axes carrying the massage rings are at an angle with respect to the rod-shaped handle.

The massage device 1 shown in FIGS. 3 and 4 comprises a rod-shaped handle 2, which—deviating from the embodiment example according to FIGS. 1 and 2—carries axes 3*a* and 3*b*, on each of which a multitude of freely rotatably supported massage rings 4 are arranged, which are held at a certain distance from each other by interposed distance rings 5. Here also, the massage rings 4 have a considerably larger diameter than the distance rings 5 and are equipped with short needle tips arranged uniformly distributed along their circumference. As in the embodiment example of FIG. 1 and 2, each of the massage rings 4 is here also equipped at the circumference with 20 uniformly distributed needle tips and the distance rings 5 are so dimensioned, that a distance of 3 mm exists between the needle points of two massage rings 4 arranged next to each other on the axes 3*a* and 3*b*.

The length of the axes 3*a*, 3*b* is here also appropriately such, that on each of them 25 to 30 massage rings 4 can, for instance, be arranged with interposition of distance rings 5. The actual operational portion of the massage device 1 is thus given a length dimension, which allows simultaneous treatment of larger skin surfaces or reflex zone areas.

The two axes 3*a*, 3*b* supporting the massage rings 4 are each arranged at one end of a transverse bar 6*a* at right angles to same, where the transverse bar 6*a* has a flat projection at the center. This bar projection 7 engages into a slit 9 of a forked shaft 8, which is located at one end of the rod-shaped handle 2. A bolt 10 is inserted into bores in the two legs of the forked shaft 8 and into a hole in the bar projection 7 registering with these and fixed in such a way, for instance by screwing or riveting, that the bar projection 7, fork shaft 8 and bolt 10 form together a transverse articulation, by means of which the handle 2 can be angularly adjusted from the aligned position with the axes 3*a*, 3*b* carrying the massage rings, at least partially up to the angular position shown in FIG. 4. In the massage device according to FIGS. 3 and 4 the angle adjustment sector of the transverse articulation should also be of such magnitude that it amounts to at least 35°.

Depending upon the manipulation of the rod-shaped handle 2, the rod-shaped handle 2 and the axes 3*a*, 3*b*, carrying the massage rings 4, assume during use of the massage device 1 angular positions with respect to each other, which lie either near 145° or 215°.

By this angular adjustability of the massage device the possibility is given to reach spots accessible only with difficulty in the course of self-treatment. It serves an easy treatment covering a large surface of the skin and/or a reflex zone also in this case, if the length of the axes 3*a*, 3*b* carrying the massage rings 4 is dimensioned to be at least approximately equal to the length of the handle 2. Thus, if the rod-shaped handle 2 has a length of approximately 100 mm, the axes 3*a*, 3*b* carrying the massage rings 4 could have a minimum length of about 90 mm.

In the case of the massage device according to FIGS. 3 and 4, it should also be assured that the rod-shaped handle 2 and the axes 3*a*, 3*b* carrying the massage rings 4 are only tightly angle-adjustable with respect to each other by means of a transverse articulation, and that at least the two angular end positions of the transverse articulation can be fixed with respect to each other, for instance clamped tightly or detented Efficient operation of the massage device 1 can be maintained for a long time, if the needle tips of the massage rings 4 are protected against damage. The protective hood 11 serves this purpose, which can be axially slid over the axes 3*a*, 3*b* carrying the massage rings 4.

Figure 5:
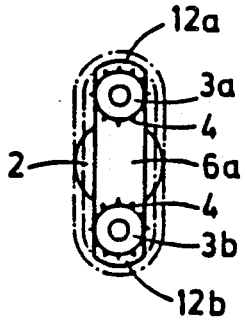
FIG. 5 is a front view of the massage device according to FIG. 3 in the direction of arrow V.

As can be seen in FIG. 5, the width of the transverse bar 6*a* is smaller than the diameter of the massage rings 4, so that their efficient action is assured also in the vicinity of the bar. In order to be able to fix the protective hood 11 in its slid over position in spite of that on the transverse bar 6*a*, profile pieces 12*a*, 12*b* are formed at both ends of same. They correspond with respect to their distance and their shape to the inside width of the protective hood 11, which is shown dotted in FIG. 5.

The massage device according to FIG. 6 has two parallel axes 21, on which the massage rings 22 are freely rotatably supported. Distance rings 23 are located in between the massage rings 22, which maintain a distance between the massage rings 22.

The two axes 21 are retained by means of a U-shaped support piece 24. As shown in FIG. FIG. 7, in the flanges 25 of the U-shaped support piece 24 (not distinguishable) support eyelets 29 aligned with each other are located. Each pair of support eyelets 29 receives an axis 21.

A connecting bolt 27 is arranged perpendicularly on the bar 26 of the U-shaped support piece 24, which extends into a handle 28. The connecting bolt 27 forms an angle of 120° with the handle 28.

The massage rings 22 have a considerably larger diameter than the distance rings 23 and are equipped on their circumference with uniformly distributed short needle tips. It has been shown to be advantageous to provide each of the massage rings 22 on its circumference with approximately 20 uniformly distributed needle tips and to dimension the distance rings in such a way that a distance of approximately 3 mm exists in between the needle tips of two massage rings 22 arranged next to each other on the axis 21.

It is in this case also appropriate to dimension the lengths of the axes 21 in such a way that, for instance, 30 to 40 massage rings 22 can be arranged on them with interposition of distance rings 23

The actual active portion of the massage device is thus given a length permitting a uniform treatment of more extensive skin surfaces and reflex zone areas.

In deviation from the embodiment example depicted in FIG. 6, the massage device can be equipped with only one axis 21 carrying massage rings or yet with more than two such axes 21.

As FIG. 6 further shows, handle 28 is extendable by a post 30 which can be slid onto handle 28.

I claim:

1. Massage device for rolling massage of skin zones and reflex zones of the human body comprising a single handle, at least one axis (3 or 21) attached only to said single handle (2 or 28), freely rotatable massage rings (4 or 22) arranged on the axis, each massage ring comprising a plurality of pyramid-shaped needle tips distributed uniformly in circumferential direction of the massage rings, the needle tips being of a non-deformable material, the height, of the needle tips from the massage rings being between 1 and 2 mm.

2. Massage device according to claim 1, wherein the handle (2) is angularly adjustable from an axially aligned position at least in part by means of a transverse articulation (7, 9, 10) with respect to the axle (3) supporting the massage rings (4).

3. Massage device according to claim 2, characterized in that the angular adjustment sector of the transverse articulation (7, 8, 9, 10) amounts to at least 35°.

4. Massage device according to claims 2 or 3, wherein at least the two angular end positions of the transverse articulation are fixable.

5. Massage device according to claim 1, wherein the length of the axis (3 or 3*a*, or 3*b*) carrying the massage rings (4) is dimensioned to be approximately equal to the length of the handle (2).

6. Massage device according to claim 1, comprising two parallel axes (3*a*, 3*b*) for the freely rotatably supported massage rings (4), the two axes (3*a*, 3*b*) being attached at the end of a transverse bar (6*a*) fixed solidly to the handle, said axes being at right angles to the transverse bar.

7. Massage device according to claim 6, wherein the thickness of the transverse bar (6*a*) is smaller than the diameter of the massage rings (4).

8. Massage device according to claims 6 or 7, wherein the handle (2) is arranged to be angularly adjustable relative to the axes (3*a*, 3*b*) supporting the massage rings (4) by means of the transverse articulation (7, 8, 9, 10) at the transverse bar (6*a*).

9. Massage device according to claim 2, including a protective hood (11) slidable over the portion of the length which is equipped with massage rings (4).

10. Massage device according to claim 9, wherein the length of the protective hood (11) is made sufficient so as to cover the transverse articulation (7, 8, 9, 10) in the aligned position of the rod-shaped handle (2) with the axis (3) carrying the massage rings (4) and so as to also partially overlap the portion of the rod-shaped handle (2) adjacent to the transverse articulation (7, 8, 9, 10).

11. Massage device according to claims 9 or 10, wherein profile pieces (12*a*, 12*b*) are attached at both ends of the transverse bar (6*a*) for fixing the slid-on protective hood (11), which correspond to the inside width and shape of the protective hood (11).

12. Massage device according to claim 1 with massage rings 23, and distance rings (23) arranged between the massage rings and freely rotatably supported on said axis (21) attached to the rod-shaped handle (28), and a U-shaped piece (24) with two flanges (25) and a support piece bar (26), with eyelets for receiving the axis (21) disposed in the two flanges (25) and aligned with each other, the handle (28) being connected with the support piece (24) by means of a connecting bolt (27) arranged perpendicularly to the support piece bar (26).

13. Massage device according to claim 12, including two parallel axes (21), carrying said massage rings (22), and a corresponding number of pairs of support eyelets aligned with each other and carrying said axes, said support eyelets being disposed in the support piece flanges (25), and the connecting bolt (27) and handle (28) forming an obtuse angle with each other.

14. Massage device according to claim 12 or 13, wherein the thickness of the support piece flanges (25) corresponds to the width of one distance ring (23) and that each flange (25) is arranged between two massage rings (22) next to each other, whereby the needle tips of the massage rings (22) in their active circumferential area extend beyond the external dimensions of the support eyelets (FIG. 6).

15. Massage device according to claim 13, wherein the axes (21) are supported in the support eyelets with play.

16. Massage device according to claim 12, further including a part which can be slid over the handle (28) to extend the handle and means to detent the part with the handle (28).

17. Massage device according to claim 4, including means for tightly clamping said transverse articulation.

18. Massage device according to claim 4, including means for tightly detenting said transverse articulation.

19. Massage device according to claim 13, wherein the obtuse angle is 120°.

20. Massage device according to claim 1, wherein the needle tips are of metal.

21. Massage device for rolling massage of skin zones and reflex zones of the human body, the massage device comprising a single handle and at least one axis attached only to said single handle, a plurality of freely rotatable massage rings mounted on the at lease one axis, each massage ring having approximately twenty needle tips distributed uniformly in circumferential direction thereof, the needle tips being of a non-deformable material, each needle tip having a height between 1 and 2 mm.

22. The massage device according to claim 21, wherein twenty-five to thirty massage rings are mounted on the at least one axis.

23. The massage device according to claim 21, comprising distance rings mounted between adjacent massage rings, the distance rings having such a dimension that the distance between the message rings is approximately 3 mm.

24. The massage device according to claim 21, wherein the at least one axis has a minimum length of approximately 90 mm.

* * * * *